US011833526B2

(12) United States Patent
Koser

(10) Patent No.: US 11,833,526 B2
(45) **Date of Patent: *Dec. 5, 2023**

(54) BACKGROUND DEFOCUSING AND CLEARING IN FERROFLUID-BASED CAPTURE ASSAYS

(71) Applicant: Ancera Inc., Branford, CT (US)

(72) Inventor: Hur Koser, Wallingford, CT (US)

(73) Assignee: Ancera Inc., Branford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/704,820

(22) Filed: Mar. 25, 2022

(65) Prior Publication Data

US 2022/0212201 A1 Jul. 7, 2022

Related U.S. Application Data

(63) Continuation of application No. 15/739,466, filed as application No. PCT/US2016/039394 on Jun. 24, 2016, now Pat. No. 11,285,490.

(Continued)

(51) Int. Cl.

| | |
|---|---|
| ***B03C 1/253*** | (2006.01) |
| ***B03C 1/023*** | (2006.01) |
| ***B03C 1/32*** | (2006.01) |

(52) U.S. Cl.

CPC ..... *B03C 1/253* (2013.01); *B03C 1/023* (2013.01); *B03C 1/32* (2013.01);

(Continued)

(58) Field of Classification Search

CPC ..... B03C 1/253; B03C 1/023; B03C 1/32; B03C 2201/26; B03C 2201/18; B01L 2400/043

See application file for complete search history.

(56) References Cited

U.S. PATENT DOCUMENTS 3,202,576 A 8/1965 Rogers et al.
3,477,948 A 11/1969 Inoue et al.

(Continued)

FOREIGN PATENT DOCUMENTS

AU 2017202597 B2 8/2019
CN 101087655 A 12/2007

(Continued)

OTHER PUBLICATIONS

Anonymous: "Most Probable Number (MPN) Test: Principle, Procedure and Results-Learn Microbiology Online", Jul. 22, 2020 (Jul. 22, 2020), XP055856599, Retrieved from the Internet: URL:https://web.archive.org/web/20200722010422/https://microbeonline.com/probable-number-mpntest-principle-procedure-results/ [retrieved on Nov. 1, 2021].

(Continued)

*Primary Examiner* — Michael McCullough
*Assistant Examiner* — Kalyanavenkateshware Kumar
(74) *Attorney, Agent, or Firm* — Myers Bigel, P.A.

(57) ABSTRACT

Devices, methods, and systems are provided for extracting particles from a ferrofluid. Such methods may comprise receiving a flow of ferrofluid comprising target particles and background particles and generating a first, focusing magnetic field to focus the target particles towards a capture region. The capture region may capture the target particles and a plurality of background particles. A second, defocusing magnetic field may be configured to remove background particles from the capture region. A detector may be used to detect the target particles bound to the target region.

13 Claims, 10 Drawing Sheets

Related U.S. Application Data

(60) Provisional application No. 62/185,534, filed on Jun. 26, 2015.

(52) U.S. Cl.
CPC ..... *B01L 2400/043* (2013.01); *B03C 2201/18* (2013.01); *B03C 2201/26* (2013.01)

(56) References Cited

U.S. PATENT DOCUMENTS 3,764,540 A 10/1973 Khalafalla et al.
3,898,156 A 8/1975 Kaiser et al.
4,448,534 A 5/1984 Wertz et al.
4,935,147 A 6/1990 Ullman et al.
5,076,950 A 12/1991 Ullman et al.
5,194,133 A 3/1993 Clark et al.
5,439,586 A 8/1995 Richards et al.
5,932,100 A 8/1999 Yager et al.
5,998,224 A 12/1999 Rohr et al.
6,038,104 A 3/2000 Sato et al.
6,045,755 A 4/2000 Lebl et al.
6,303,389 B1 10/2001 Levin et al.
6,309,889 B1 10/2001 Cutler et al.
6,432,630 B1 8/2002 Blankenstein
6,596,143 B1 7/2003 Wang et al.
6,610,186 B1 8/2003 Mayer et al.
6,620,627 B1 9/2003 Liberti et al.
6,663,757 B1 12/2003 Fuhr et al.
7,960,311 B2 6/2011 Carlson
8,364,409 B2 1/2013 Rieder et al.
8,961,878 B2 2/2015 Koser
8,961,898 B2 2/2015 Nisisako et al.
9,352,317 B2 5/2016 Koser
9,415,398 B2 8/2016 Yellen et al.
9,557,326 B2 1/2017 Inaba et al.
9,726,592 B2 8/2017 Koser
9,999,855 B2 6/2018 Koser
10,016,498 B2 7/2018 Bertozzi et al.
10,302,634 B2 5/2019 Koser
10,544,444 B2 1/2020 Vannieuwenhze et al.
10,632,463 B2 4/2020 Koser
10,782,223 B2 9/2020 Koser
11,204,350 B2 12/2021 Koser
11,285,490 B2 3/2022 Koser
11,383,247 B2 7/2022 Koser
2002/0003001 A1 1/2002 Weigl et al.
2002/0016751 A1 2/2002 Sekiya
2002/0049782 A1 4/2002 Herzenberg et al.
2002/0059132 A1 5/2002 Quay et al.
2002/0106314 A1 8/2002 Pelrine et al.
2002/0144934 A1 10/2002 Exner
2003/0159999 A1 8/2003 Oakey et al.
2003/0203507 A1 10/2003 Liberti et al.
2003/0235504 A1 12/2003 Lemoff et al.
2004/0018611 A1 1/2004 Ward et al.
2004/0067167 A1 4/2004 Zhang et al.
2004/0096977 A1 5/2004 Rakestraw et al.
2005/0012579 A1 1/2005 Underwood et al.
2005/0199550 A1 9/2005 Haney et al.
2005/0233472 A1 10/2005 Kao et al.
2005/0237528 A1 10/2005 Oldham et al.
2005/0244932 A1 11/2005 Harding
2005/0266433 A1 12/2005 Kapur et al.
2005/0280811 A1 12/2005 Sandell
2006/0011305 A1 1/2006 Sandell et al.
2006/0011552 A1 1/2006 Utsunomiya
2006/0013984 A1 1/2006 Sandell et al.
2006/0024690 A1 2/2006 Kao et al.
2006/0024831 A1 2/2006 Kao et al.
2006/0029948 A1 2/2006 Lim et al.
2006/0166357 A1 7/2006 Takayama et al.
2006/0188399 A1 8/2006 Smid
2006/0286549 A1 12/2006 Sohn et al.
2007/0014694 A1 1/2007 Beard et al.
2007/0015289 A1 1/2007 Kao et al.
2007/0125971 A1 6/2007 Wimberger-Friedl et al.
2007/0134809 A1 6/2007 Cho et al.
2007/0196820 A1 8/2007 Kapur et al.
2007/0215553 A1 9/2007 Yellen et al.
2007/0224084 A1 9/2007 Holmes et al.
2008/0000892 A1 1/2008 Hirano et al.
2008/0006202 A1 1/2008 Hirano et al.
2008/0035541 A1 2/2008 Franzreb et al.
2008/0038725 A1 2/2008 Luo et al.
2008/0148821 A1 6/2008 Donsky et al.
2008/0210560 A1 9/2008 Barringer
2008/0255006 A1 10/2008 Wang et al.
2008/0302732 A1 12/2008 Soh et al.
2009/0035838 A1 2/2009 Quake et al.
2009/0050569 A1 2/2009 Jung et al.
2009/0078614 A1 3/2009 Varghese et al.
2009/0148933 A1 6/2009 Battrell et al.
2009/0165876 A1 7/2009 Atkin et al.
2009/0175797 A1 7/2009 Warren et al.
2009/0220932 A1 9/2009 Ingber et al.
2009/0227044 A1 9/2009 Dosev et al.
2009/0251136 A1 10/2009 Prins et al.
2009/0325276 A1 12/2009 Battrell et al.
2010/0068824 A1 3/2010 Kimura
2010/0075340 A1 3/2010 Javanmard et al.
2010/0093052 A1 4/2010 Chalmers et al.
2010/0120077 A1 5/2010 Daridon
2011/0003392 A1 1/2011 Stayton et al.
2011/0020459 A1 1/2011 Achrol et al.
2011/0059468 A1 3/2011 Earhart et al.
2011/0065209 A1 3/2011 Heil et al.
2011/0114490 A1 5/2011 Pamula et al.
2011/0124116 A1 5/2011 Wohlstadter et al.
2011/0137018 A1 6/2011 Chang-Yen et al.
2011/0212440 A1 9/2011 Viovy et al.
2011/0262893 A1 10/2011 Dryga et al.
2011/0312518 A1 12/2011 Davis et al.
2012/0080360 A1 4/2012 Stone et al.
2012/0108470 A1* 5/2012 Oh ..... B01L 3/502776 506/39
2012/0178645 A1 7/2012 Foekens et al.
2012/0190589 A1 7/2012 Anderson et al.
2012/0237997 A1 9/2012 Koser
2013/0140241 A1 6/2013 Yellen et al.
2013/0189794 A1 7/2013 Emeric et al.
2013/0261010 A1 10/2013 Bailey et al.
2013/0313113 A1* 11/2013 Koser ..... B01L 3/502753 204/601
2014/0044600 A1 2/2014 McAlister
2014/0214583 A1 7/2014 Assuncao et al.
2014/0283945 A1 9/2014 Jones et al.
2015/0041396 A1 2/2015 Kelly et al.
2015/0151299 A1 6/2015 Koser
2016/0016171 A1 1/2016 Goel
2016/0188399 A1 6/2016 Benedict
2016/0263574 A1 9/2016 Smith et al.
2016/0266026 A1 9/2016 Koser
2016/0296944 A1 10/2016 Koser
2016/0296945 A1 10/2016 Koser
2016/0299052 A1 10/2016 Koser
2016/0299126 A1 10/2016 Koser
2016/0299132 A1 10/2016 Koser
2017/0122851 A1 5/2017 Thatcher et al.
2017/0259265 A1 9/2017 Diller et al.
2017/0285060 A1 10/2017 Koser
2017/0297028 A1 10/2017 Jones et al.
2018/0017557 A1 1/2018 Fritz et al.
2018/0029033 A1 2/2018 Koser et al.
2018/0029035 A1 2/2018 Koser et al.
2018/0128671 A1 5/2018 Paur et al.
2018/0128729 A1 5/2018 Koser
2018/0188246 A1 7/2018 Koser
2018/0361397 A1 12/2018 Koser
2019/0024132 A1 1/2019 Van Nieuwenhze et al.
2019/0091699 A1 3/2019 Koser
2019/0118190 A1 4/2019 Koser
2019/0120822 A1 4/2019 Koser
2019/0169158 A1 6/2019 Springer et al.
2019/0339262 A1 11/2019 Koser

(56) References Cited

U.S. PATENT DOCUMENTS

| | | | |
|---|---|---|---|
| 2020/0306758 | A1 | 10/2020 | Dhlakama |
| 2020/0353466 | A1 | 11/2020 | Koser |
| 2022/0107311 | A1 | 4/2022 | Koser |

FOREIGN PATENT DOCUMENTS

| | | | |
|---|---|---|---|
| CN | 201125246 | Y | 10/2008 |
| CN | 104535783 | A | 4/2015 |
| CN | 105142789 | A | 12/2015 |
| JP | 2006187770 | A | 7/2006 |
| JP | 2009511001 | A | 3/2009 |
| JP | 2009133818 | A | 6/2009 |
| WO | WO-9101381 | A1 | 2/1991 |
| WO | WO-2006004558 | A1 | 1/2006 |
| WO | WO-2006067715 | A2 | 6/2006 |
| WO | WO-2008042003 | A2 | 4/2008 |
| WO | WO-2008130977 | A2 | 10/2008 |
| WO | WO-2010117428 | A1 | 10/2010 |
| WO | WO-2010117458 | A1 | 10/2010 |
| WO | WO-2011071812 | A2 | 6/2011 |
| WO | WO-2011071912 | A1 | 6/2011 |
| WO | WO-2011139233 | A1 | 11/2011 |
| WO | WO-2012057878 | A1 | 5/2012 |
| WO | WO-2012142664 | A1 | 10/2012 |
| WO | WO-2013054311 | A1 | 4/2013 |
| WO | WO-2013155525 | A1 | 10/2013 |
| WO | WO-2014044810 | A1 | 3/2014 |
| WO | WO-2014065317 | A1 | 5/2014 |
| WO | WO-2014100456 | A1 | 6/2014 |
| WO | WO-2014144340 | A1 | 9/2014 |
| WO | WO-2014144782 | A2 | 9/2014 |
| WO | WO-2014144810 | A1 | 9/2014 |
| WO | WO-2014145765 | A1 | 9/2014 |
| WO | WO-2014165317 | A1 | 10/2014 |
| WO | WO-2016210348 | A2 | 12/2016 |
| WO | WO-2017004595 | A1 | 1/2017 |
| WO | WO-2017085098 | A1 | 5/2017 |
| WO | WO-2017192633 | A1 | 11/2017 |
| WO | WO-2018026605 | A1 | 2/2018 |
| WO | WO-2019103741 | A1 | 5/2019 |
| WO | WO-2019117877 | A1 | 6/2019 |
| WO | WO-2022015845 | A2 | 1/2022 |
| WO | WO-2022040589 | A1 | 2/2022 |
| WO | WO-2022169905 | A1 | 8/2022 |

OTHER PUBLICATIONS

Applegate et al., "Optical trapping, manipulation, and sorting of cells and colloids in microfluidic systems with diode laser bars", Optical Express 12:4390-4398 (2004).

Ashkin et al., "Optical trapping and manipulation of single cells using infrared laser beams," Nature 330:769-771 (1987).

Ashkin et al., "Optical trapping and manipulation of viruses and bacteria," Science 235:1517-1520 (1987).

Asmatulu, R. et al., "A Ferrofluid Guided System for the Rapid Separation of the Non-Magnetic Particles in a Microfluidic Device," Journal of Neuroscience and Nanotechnology, 10:1-5 (2010).

Bautista et al., "Comparative study of ferrofluids based on dextran-coated iron oxide and metal nanoparticles for contrast agents in magnetic resonance imaging," Nanotechnology 15:S154-S159 (2004).

Beyor et al., "Immunomagnetic bead-based cell concentration microdevice for dilute pathogen detection," Biomed Microdevices 10:909-917 (2008).

Blattner et al., "The complete genome sequence of *Escherichia coli* K-12," Science 277:1453-1474 (1997).

Bushkin, G.G., et al., "Evidence for a Structural Role for Acid-fast Lipids in Oocyst Walls of Cryptosporidium, Toxoplasma, and Eimeria," MBIO, Nov. 1, 2013, vol. 4(5), XP55917717.

Cabrera et al., "Continuous concentration of bacteria in a microfluidic flow cell using electrokinetic techniques," Electrophoresis 22:355-362 (2001).

Castagiuolo et al., "Engineered *E. coli* delivers therapeutic genes to the colonic mucosa," Gene Therapy 12:1070-1078 (2005).

Cheong et al., "Gold nanoparticles for one step DNA extraction and real-time PCR of pathogens in a single chamber," Lab Chip 8:810-813 (2008).

Chiou et al., "Massively parallel manipulation of single cells and microparticles using optical images," Nature 436:370-372 (2005).

Davis et al., "Deterministic hydrodynamics: Taking blood apart," Proc Natl Acad Sci USA 103:14779-14784 (2006).

Dittrich et al., "Lab-on-a-chip: microfluidics in drug discovery," Nat. Rev. Drug Discovery 5:210-218 (2006).

Dufresne et al., "Optical tweezer arrays and optical substrates created with diffractive optics," Rev Sci Instrum 69:1974-1977 (1998).

Dumesny et al., "Synthesis, expression and biological activity of the prohormone for gastrin releasing peptide," Endocrinology 147(1):502-509 (2006).

Examination Report dated Oct. 1, 2021 for European Application No. 17837424.5, 6 pages.

Examination Report No. 1 dated Nov. 18, 2016 for Australian Application No. 2015268583, 4 pages.

Extended European Search Report dated Dec. 11, 2017 for European Application No. 10836542.0, 10 pages.

Extended European Search Report dated Dec. 13, 2017 for European Application No. 11836778.8, 9 pages.

Extended European Search Report dated Jun. 14, 2021 for European Application No. 17934894.1, 6 pages.

Extended European Search Report dated Mar. 12, 2020 for European Application No. 17837424.5, 15 pages.

Final Office Action for U.S. Appl. No. 16/772,681 dated Jun. 7, 2023, 16 pages.

Final Office Action dated Apr. 24, 2014 for U.S. Appl. No. 13/514,331, 16 pages.

Final Office Action dated Apr. 8, 2019 for U.S. Appl. No. 15/623,134, 13 pages.

Final Office Action dated Aug. 31, 2017 for U.S. Appl. No. 14/777,511, 12 pages.

Final Office Action dated Dec. 12, 2019 for U.S. Appl. No. 15/739,466, 9 pages.

Final Office Action dated Dec. 20, 2017 for U.S. Appl. No. 14/777,505, 25 pages.

Final Office Action dated Dec. 22, 2017 for U.S. Appl. No. 14/777,512, 13 pages.

Final Office Action dated Feb. 21, 2017 for U.S. Appl. No. 13/882,013, 6 pages.

Final Office Action dated Feb. 21, 2019 for U.S. Appl. No. 14/777,511, 18 pages.

Final Office Action dated Feb. 27, 2018 for U.S. Appl. No. 14/777,504, 10 pages.

Final Office Action dated Jan. 17, 2020 for U.S. Appl. No. 15/660,616, 14 pages.

Final Office Action dated Mar. 13, 2017 for U.S. Appl. No. 15/163,890, 8 pages.

Final Office Action dated Mar. 16, 2021 for U.S. Appl. No. 16/113,793, 11 pages.

Final Office Action dated Mar. 18, 2021 for U.S. Appl. No. 15/660,616, 22 pages.

Final Office Action dated Mar. 8, 2021 for U.S. Appl. No. 16/013,793, 16 pages.

Final Office Action dated Nov. 17, 2017 for U.S. Appl. No. 14/777,507, 14 pages.

Final Rejection Office Action for U.S. Appl. No. 16/113,793 dated Nov. 8, 2022, 27 pages.

First Office Action dated Feb. 20, 2021 for Chinese Application No. 201780060346.2, with English language translation, 12 pages.

Fischer et al., Ferro-microfluidic device for pathogen detection, IEEE Int Conf on Nano/Micro Eng and Molecular System China, 907-910 (2008).

Gijs, "Magnetic bead handling on-chip: new opportunities for analytical applications," Microfluid Nanofluid 1:22-40 (2004).

Goldman et al., "Slow viscous motion of a sphere parallel to a plane wall-I motion through a quiescent fluid," Chem Eng Sci 22:637-651 (1967).

(56) References Cited

OTHER PUBLICATIONS

Green, "The Sigma-Aldrich Handbook of Stains, Dyes & Indicators," Aldrich Chemical Co., Milwaukee, WI, 721-722 (1990).
Han et al., Kynurenine aminotransferase and glutamine transaminase K of *Escherichia coli*: Identity with aspartate aminotransferase,' Biochemical Journal 360(3):617-623 (2001).
Horan et al., "Stable cell membrane labeling," Nature 340:167-168 (1989).
Hughes, "Strategies for dielectrophoretic separation in laboratory-on-a-chip systems," Electrophoresis 23:2569-2582 (2002).
International Preliminary Report on Patentability for International Application No. PCT/US2021/041616 dated Jan. 26, 2023, 17 pages.
International Preliminary Report on Patentability for International Application No. PCT/US2021/046997 dated Mar. 2, 2023, 9 pages.
International Search Report and Written Opinion for International Application No. PCT/US2022/014987, dated May 17, 2022, 19 pages.
International Search Report and Written Opinion dated Aug. 11, 2014 for International Application No. PCT/US2014/030584, 7 pages.
International Search Report and Written Opinion dated Aug. 20, 2014 for International Application No. PCT/US2014/030629, 9 pages.
International Search Report and Written Opinion dated Aug. 5, 2014 for International Application No. PCT/US2014/028705, 6 pages.
International Search Report and Written Opinion dated Aug. 5, 2014 for International Application No. PCT/US2014/029376, 9 pages.
International Search Report and Written Opinion dated Dec. 1, 2022 for International Application No. PCT/US2021/041616, 22 pages.
International Search Report and Written Opinion dated Dec. 23, 2016 for International Application No. PCT/US2016/039394, 8 pages.
International Search Report and Written Opinion dated Feb. 22, 2018 for International Application No. PCT/US2017/065883, 13 pages.
International Search Report and Written Opinion dated Feb. 8, 2011 for International Application No. PCT/US2010/059270, 10 pages.
International Search Report and Written Opinion dated Oct. 10, 2014 for International Application No. PCT/US2014/029336, 12 pages.
International Search Report and Written Opinion dated Oct. 18, 2011 for International Application No. PCT/US2011/039516, 7 pages.
International Search Report and Written Opinion dated Oct. 6, 2017 for International Application No. PCT/US2017/043985, 9 pages.
International Search Report and Written Opinion dated Sep. 13, 2016 for International Application No. PCT/US2016/040861, 6 pages.
Ise, "When, why, and how does like like like?—Electrostatic attraction between similarly charged species," Proc Jpn Acad B Phys Biol Sci 83:192-198 (2007).
Jayashree et al., "Identification and Characterization of Bile Salt Hydrolase Genes from the Genome of *Lactobacillus fermentum* MTCC 8711," Applied Biochemistry and Biotechnology 174(2):855-866 (2014).
Kamei et al., "Microfluidic Genetic Analysis with an Integrated a-Si:H Detector," Biomed Microdevices 7:147-152 (2005).
Kang et al., "Monitoring of anticancer effect of cisplatin and 5-fluorouracil on HepG2 cells by quartz crystal microbalance and micro CCD camera," Biosensors and Bioelectronics 26:1576-1581 (2010).
Kashevsky, "Nonmagnetic particles in magnetic fluid: Reversal dynamics under rotating field," Phys Fluids 9:1811-1818 (1997).
Kim et al., "Cloning and characterization of the bile salt hydrolase genes (bsh) from Bifidobacterium bifidum strains," Applied and Environmental Biology 70(9):5603-5612 (2004).
Kim et al., "Synthesis of ferrofluid with magnetic nanoparticles by sonochemical method for MRI contrast agent," J Magn Magn Mater 289: 328-330 (2005).
Kose et al., "Ferrofluid mediated nanocytometry," Lab Chip 12:190-196 (2012).
Kose et al., "Label-free cellular manipulation and sorting via biocompatible ferrofluids," Proc. Nat'l. Acad. Sci. USA, 106(51):21478-21483 (2009).
Kose et al., "Towards Ferro-microfluidics for Effective and Rapid Cellular Manipulation and Sorting," Proceedings of the IEEE Int. Conf. on Nano/Microengineered and Molecular Systems, Jan. 6-9, 2008, pp. 903-906.
Kose et al., "Supporting information to Label-free cellular manipulation and sorting via biocompatible microfluids," Proceedings of the National Academy of Sciences USA; retrieved from the Internet: http://www.pnas.org/cgi/content/short/0912138106 (2009), 6 pages.
Kremser et al., "Capillary electrophoresis of biological particles: Viruses, bacteria, and eukaryotic cells," Electrophoresis 25:2282-2291 (2004).
Kumar et al., "Molecular cloning, characterization and heterologous expression of bile salt hydrolase (bsh) from *Lactobacillus fermentum* NCD0394," Molecular Biology Reports 40(8):5057-5066 (2013).
Lee et al., "Microelectromagnets for the control of magnetic nanoparticles," Appl Phys Lett 79:3308-3310 (2001).
Lekka et al., "Elasticity of normal and cancerous human bladder cells studies by scanning force microscopy," Eur Biophys J 28:312-316 (1999).
Liu et al., "Evidence for Localized Cell Heating Induced by Infrared Optical Tweezers," Biophys J 68:2137-2144 (1995).
Maiorov, "Experimental Study of the Permeability of a ferrofluid in an alternating magnetic field," Magnetohydrodynamics 15:135-139 (1979).
Mao et al., "Towards ferrofluidics for μ-TAS and lab on-a-chip applications," Nanotechnology 17:34-47 (2006).
Massart, "Preparation of Aqueous Magnetic Liquids in Alkaline and Acid Media," IEEE Trans Magn 17:1247-1248 (1981).
Menachery et al., Controlling cell destruction using dielectrophoretic forces,' NanoBiotechnology 152:145-149 (2005).
Muller et al., "The Potential of Dielectrophoresis for Single-Cell Experiments," IEEE Eng Biol Med Mag 22:51-61 (2003).
Non Final Office Action for U.S. Appl. No. 16/419,982, dated Nov. 22, 2022, 14 pages.
Non-Final Office Action dated Apr. 1, 2015 for U.S. Appl. No. 14/591,492, 7 pages.
Non-Final Office Action dated Apr. 28, 2017 for U.S. Appl. No. 14/777,505, 24 pages.
Non-Final Office Action dated Apr. 3, 2020 for U.S. Appl. No. 16/013,793, 18 pages.
Non-Final Office Action dated Apr. 5, 2019 for U.S. Appl. No. 15/739,466, 8 pages.
Non-Final Office Action dated Aug. 1, 2017 for U.S. Appl. No. 14/777,512, 18 pages.
Non-Final Office Action dated Aug. 22, 2019 for U.S. Appl. No. 15/660,606, 10 pages.
Non-Final Office Action dated Aug. 31, 2018 for U.S. Appl. No. 15/623,134, 12 pages.
Non-Final Office Action dated Aug. 8, 2017 for U.S. Appl. No. 14/777,504, 11 pages.
Non-Final Office Action dated Feb. 12, 2018 for U.S. Appl. No. 14/827,073, 25 pages.
Non-Final Office Action dated Jan. 16, 2020 for U.S. Appl. No. 15/623,134, 10 pages.
Non-Final Office Action dated Jan. 20, 2017 for U.S. Appl. No. 14/777,511, 13 pages.
Non-Final Office Action dated Jan. 21, 2022 for U.S. Appl. No. 16/113,793, 17 pages.
Non-Final Office Action dated Jan. 27, 2020 for U.S. Appl. No. 15/708,032, 10 pages.
Non-Final Office Action dated Jan. 28, 2021 for U.S. Appl. No. 15/739,466, 9 pages.
Non-Final Office Action dated Jul. 12, 2019 for U.S. Appl. No. 15/660,616, 17 pages.
Non-Final Office Action dated Jul. 16, 2018 for U.S. Appl. No. 14/777,511, 14 pages.
Non-Final Office Action dated Jul. 31, 2013 for U.S. Appl. No. 13/514,331, 11 pages.

(56) References Cited

OTHER PUBLICATIONS

Non-Final Office Action dated Jul. 5, 2018 for U.S. Appl. No. 15/740,288, 12 pages.
Non-Final Office Action dated Jun. 14, 2019 for U.S. Appl. No. 15/982,926, 19 pages.
Non-Final Office Action dated Jun. 2, 2017 for U.S. Appl. No. 14/777,507, 10 pages.
Non-Final Office Action dated Jun. 25, 2020 for U.S. Appl. No. 16/113,793, 8 pages.
Non-Final Office Action dated Jun. 26, 2019 for U.S. Appl. No. 15/670,264, 11 pages.
Non-Final Office Action dated Jun. 30, 2016 for U.S. Appl. No. 15/163,890, 8 pages.
Non-Final Office Action dated Oct. 14, 2021 for U.S. Appl. No. 16/013,793, 8 pages.
Non-Final Office Action dated Oct. 31, 2022 for U.S. Appl. No. 16/772,681, 22 pages.
Non-Final Office Action dated Sep. 10, 2021 for U.S. Appl. No. 16/772,681, 20 pages.
Non-Final Office Action dated Sep. 14, 2016 for U.S. Appl. No. 13/882,013, 5 pages.
Non-Final Office Action dated Sep. 21, 2022 for U.S. Appl. No. 16/859,431, 14 pages.
Non-Final Office Action dated Sep. 25, 2017 for U.S. Appl. No. 13/882,013, 6 pages.
Notice of Allowance for U.S. Appl. No. 16/859,431 dated Apr. 14, 2023, 9 pages.
Notice of Allowance for U.S. Appl. No. 16/859,431 dated May 1, 2023, 02 pages.
Office Action dated Feb. 21, 2022 for Canadian Application No. 2,902,324, 3 pages.
Office Action for Chinese Application No. CN201780097630, dated Mar. 31, 2022, 12 pages.
Office Action for Indian Application No. IN5808/DELNP/2012 dated Jan. 24, 2023, 3 pages.
Pethig et al., "Applications of dielectrophoresis in biotechnology," Trends Biotechnol 15:426-432 (1997).
Primiceri et al., "Cell chips as new tools for cell biology—results, perspectives and opportunities," Lab Chip 13:3789-3802 (2013).
Puttaswamy, S., et al., "Rapid detection of bacterial proliferation in food samples using microchannel impedance measurements at multiple frequencies", Sensing and Instrumentation for Food Quality and Safety, vol. 4, No. 3-4, Sep. 23, 2010, pp. 108-118.
Romasi et al., "Development of Indole-3-Acetic Acid-Producing *Escherichia coli* by Functional Expression of IpdC, AspC, and Iad1," Journal of Microbiology and Biotechnology 23(12):1726-1736 (2013).
Sarsero et al., "A new family of integral membrane proteins involved in transport of aromatic amino acids in *Escherichia-Coli*," Journal of Bacteriology 173(10):3231-3234 (1991).
Scherer et al., Ferrofluids: Properties and Applications,' Brazilian J Phys 45:718- 727 (2005).
Sebastian et al., "Formation of multilayer aggregates of mammalian cells by dielectrophoresis," J Micromech Microeng 16:1769-1777 (2006).
Seltmann, A., et al., "Age-specific Gastrointestinal Parasite Shedding in Free-ranging Cheetahs (Acinonyx Jubatus) on Namibian Farmland," Parasitology Research, Jan. 31, 2019, vol. 118(3), pp. 851-859.
Songbai. T, et al., "A digital quantification method for the detection of biomarkers on a microfluidic array chip," Sensors & Actuators: B. Chemical 298 (2019) 126851, 7 pages.
Steidler et al., "Genetically engineered Probiotics," Baillier's Best Practice and Research. Clinical Gastroenterology 17(5): 861-876 (2003).
Sun AE, K., et al., "Development of a rapid method to quantify *SalmonellaTyphimurium* using a combination of MPN with qPCR and a shortened time incubation", Food Microbiology, Academic Press L To, London, GB, vol. 65, Jan. 30, 2017, pp. 7-18.
Tung et al., "Magnetic properties of ultrafine cobalt ferrite particles," J Appl Phys 93:7486-7488 (2003).
Wang et al., "Expression of rat pro cholecystokinin (CCK) in bacteria and in insect cells infected with recombinant *Baculovirus*," Peptides 18(9):1295-1299 (1997).
Whelan et al., "A Transgenic Probiotic Secreting a Parasite Immunomodulator for Site-Directed Treatment of Gut Inflammation," Molecular Therapy 22(10):1730-1740 (2014).
Yan et al., "Near-field-magnetic-tweezer manipulation of single DNA molecules," Phys Rev E 70:011905 (2004).
Yellen et al., "Arranging matter by magnetic nanoparticle assemblers," Proc Natl Acad Sci USA 102:8860-8864 (2005).
Zahn et al., "Ferrohydrodynamic pumping in spatially uniform sinusoidally time-varying magnetic fields," J of Magnetism and Magnetic Materials 149:165-173 (1995).
Zhang et al., "A microfluidic system with surface modified piezoelectric sensor for trapping and detection of cancer cells," Biosens Bioelectron 26(2):935-939 (2010).
Zhang et al., "Low temperature and glucose enhanced T7 RNA polymerase-based plasmid stability for increasing expression of glucagon-like peptide-2 in *Escherichia coli*," Protein Expression and Purification 29(1):132-139 (2003).
Andrews et al., "Chapter 5: *Salmonella*", In Bacteriological Analytical Manual. U.S. Food and Drug Administration; U.S. Department of Agriculture—Food Safety and Inspection Service, Apr. 2023, 33 pages.
Baba et al., "Establishment and persistence of *Salmonella typhimurium* infection stimulated by *Eimeria tenella* in chickens", 1982, Res. Vet. Sci. 33: 95-98.
Barkway et al., "Loop-mediated isothermal amplification (LAMP) assays for the species-specific detection of *Eimeria* that infect chickens", 2011, BMC Vet. Res. 7: 67.
Blake et al., "Development and validation of realtime polymerase chain reaction assays specific to four species of *Eimeria*", 2008, Avian Pathol. 37: 89-94.
Blake et al., "Population, genetic, and antigenic diversity of the apicomplexan *Eimeria tenella* and their relevance to vaccine development", 2015, Proc. Natl. Acad. Sci. 112: E5343-E5350.
Blake et al., "Re-calculating the cost of coccidiosis in chickens", 2020, Vet. Res. 51: 115.
Cantacessi et al., "Genetic characterization of three unique operational taxonomic units of *Eimeria* from chickens in Australia based on nuclear spacer ribosomal DNA", 2008, Vet. Parasitol. 154: 226-234.
Cason et al., "A history of bingeing on fat enhances cocaine seeking and taking", Behav Neurosci. Dec. 2011; 125(6): 930-42. doi: 10.1037/a0025759. Epub Oct. 10, 2011.
Chapman et al., "A selective review of advances in coccidiosis research" 2013, Adv. Parasitol.83: 93-171.
Chapman et al., "Forty years of monensin for the control for the control of coccidiosis in poultry", 2010, Poult. Sci. 89: 1788-1801.
Chapman et al., "Milestones in avian coccidiosis research: a review", 2014, Poult. Sci. 93: 501-511.
Chasser et al., "Evaluating fecal shedding of oocysts in relation to body weight gain and lesion scores during Eimeria infection", 2020, Poult. Sci. 99: 886-892.
Cox et al., "Population Analyses Reveal Preenrichment Method and Selective Enrichment Media Affect *Salmonella* Serovars Detected on Broiler Carcasses", 2019, J Food Prot 82:1688-1696.
Dalloul et al., "Poultry coccidiosis: recent advancements in control measures and vaccine development", 2006, Expert Rev. Vaccines. 5: 143-163.
Davey et al., "Estimation of Microbial Viability Using Flow Cytometry", 2020, Curr Protoc Cytom. Jun. 2020; 93(1): e72. doi: 10.1002/cpcy.72, 13 pages.
Deaven et al., "*Salmonella* Genomics and Population Analyses Reveal High Inter-and Intraserovar Diversity in Freshwater", Applied and Environmental Microbiology, 2021, 87(6): e02594-20.
Final Office Action for U.S. Appl. No. 16/419,982 dated Aug. 3, 2023, 20 pages.
Flint et al., "A rapid, two-hour method for the enumeration of total viable bacteria in samples from commercial milk powder and whey

(56) References Cited

OTHER PUBLICATIONS protein concentrate powder manufacturing plants", 2006, International Diary Journal 16: 379-384.
Fuller et al., "Analysis of coccidian oocyst populations by means of flow cytometry", J Protozool. Mar. 1989-Apr. 36(2): 143-6. doi: 10.1111/j.1550-7408.1989.tb01061.
Fuller et al., "Lectin-binding by sporozoites of *Elmeria tenella*", Parasitol Res. Feb. 2002; 88(2):118-25. doi: 10.1007/s00436-001-0517-z.
Harito et al., "Lectin-magnetic separation (LMS) for isolation of Toxoplasma gondii oocysts from concentrated water samples prior to detection by microscopy or qPCR", Water Res. 2017; 114:228-236. doi:10.1016/j.watres.2017.02.044.
Haug et al., "A simplified protocol for molecular identification of *Eimeria* species in field samples", 2007, Vet. Parasitol. 146: 35-45.
Haug et al., "Coccidial infections in commercial broilers: epidemiological aspects and comparison of *Eimeria* species identification by morphometric and polymerase chain reaction techniques", 2008, Avian Pathol. 37: 161-170.
Hendricksen et al., "Global monitoring of *Salmonella serovar* distribution from the World Health Organization Global Foodborne Infections Network Country Data Bank: results of quality assured laboratories from 2001 to 2007 2011", Foodborne Pathog Dis 8: 887-900.
Holdsworth et al., "World Association for the Advancement of Veterinary Parasitology (WAAVP) guidelines for evaluating the efficacy of anticoccidial drugs in chickens and turkeys", 2004, Vet. Parasitol. 121: 189-212.
Intra et al., "Detection of intestinal parasites by use of the cuvette-based automated microscopy analyzer sediMAX", 2016, Clin. Microbiol. Infect. 22: 279-284.
Jenkins et al., "*Eimeria* oocyst concentrations and species composition in litter from commercial broiler farms during anticoccidial drug or live *Eimeria* oocyst vaccine control programs", 2017, Avian Dis. 61: 214-220.
Jenkins et al., "Improved polymerase chain reaction technique for determining the species composition of *Eimeria* in poultry litter", 2006, Avian Dis. 50: 632-635.
Jepras et al., "Development of a robust flow cytometric assay for determining numbers of viable bacteria", 1995, Applied and Environmental Microbiology vol. 61, pp. 2696-2701.
Joyner et al., "The specific characters of the *Eimeria*, with special reference to the coccidia of the fowl", 1974, Avian Pathol. 3: 145-157.
Kadykalo et al., "The value of anticoccidials for sustainable global poultry production", J. Antimicrob Agents 2018, 51: 304-410.
Kawahara et al., "Detection of five avian *Eimeria* species by species-specific real-time polymerase chain reaction assay", 2008, Avian Dis. 52: 652-656.
Kumar et al., "An optimised protocol for molecular identification of *Eimeria* from chickens", 2014, Vet. Parasitol. 199: 24-31.
Lalonde et al., "Detection and differentiation of coccidian oocysts by real-time PCR and melting curve analysis", 2011, J Parasitol. 97: 725-730.
Lee et al., "Prevalence and cross-immunity of*Eimeria* species on Korean chicken farms", 2010, J. Vet. Med. Sci. 72: 985-989.
Long et al., "Problems in the identification of species of *Eimeria*", J Protozool. Nov. 1984; 31(4): 535-41. doi: 10.1111/j.1550-7408.1984.tb05498.x.
Loo et al., "Comparison of molecular methods for the detection of *Eimeria* in domestic chickens in Malaysia", 2019, Sains Malaysiana. 48: 1425-1432.
McDougald et al., "Coccidiosis", Diseases of Poultry, 2013, 19 pages.
McDougald et al., "Drug-sensitivity of 99 isolates of coccidia from broiler farms", 1986, Avian Dis. 30: 690-4.
Morris et al., "Biotechnological advances in the diagnosis of avian coccidiosis and the analysis of genetic variation in *Eimeria*", 2006, Biotechnol. Adv. 24: 590-603.
Nolan et al., "Quantitative real-time PCR (qPCR) for *Eimeria tenella* replication-Implications for experimental refinement and animal welfare", 2015, Parasitol. Int. 64: 464-470.
Non-Final Office Action for U.S. Appl. No. 16/113,793 dated Aug. 4, 2023, 26 pages.
Peek et al., "Coccidiosis in poultry: anticoccidial products, vaccines and other prevention strategies", 2011, Vet. Q. 31: 143-161.
R Core Team. 2018. R: "A language and environment for statistical computing", R Foundation for Statistical Computing, Vienna, Austria. URL https://www.R-project.org/.
Ricciardi et al., "Diagnosis of parasitic infections: what's going on?", 2015, J. Biomol. Screen. 20: 6-21.
Shah et al., "Population Dynamics and antimicrobial resistance of the most prevalent poultry-associated *Salmonella* serotypes", 2017 Poult Sci 96: 687-702.
Siceloff et al., "Regional *Salmonella* Differences in United States Broiler Production from 2016 to 2020 and the Contribution of Multiserovar Populations to *Salmonella* Surveillance", Appl Environ Microbiol. Apr. 26, 2022; 88(8): e0020422; 13 pages.
Snyder et al., "Monitoring coccidia in commercial broiler chicken flocks in Ontario: comparing oocyst cycling patterns in flocks using anticoccidial medications or live vaccination", 2021 Poult. Sci. 100: 110-118.
Strawn et al., "Distributions of *Salmonella* Subtypes Differ between Two U.S. Produce-Growing Regions", 2014, Appl Environ Microbiol 80: 3982-3991.
Tack et al., "Preliminary Incidence and Trends of Infections with Pathogens Transmitted Commonly Through Food—Foodborne Diseases Active Surveillance Network, 10 U.S. Sites, 2015-2018", 2019, MMWR Morb Mortal Wkly Rep 68: 369-373.
Tanriverdi et al., "Detection and genotyping of oocysts of Cryptosporidium parvum by real-time PCR and melting curve analysis", J Clin Microbiol. Sep. 2002; 40(9): 3237-44. doi: 10.1128/jcm.40.9.3237-3244.2002.
Thaxton et al., "Symposium: Animal welfare challenges for today and tomorrow", 2016, Poult. Sci. 95: 2198-2207.
Thompson et al., "High-Resolution Identification of Multiple *Salmonella* Serovars in a Single Sample by Using CRISPR-SeroSeq", Applied and Environmental Microbiology, 2018, 84(21): e01859-18.
Uzzau et al., "Host adapted serotypes of *Salmonella* enterica 2000", Epidemiol Infect 125: 229-255.
Vohra et al., "Quantifying the Survival of Multiple *Salmonella enterica* Serovars In Vivo via Massively Parallel Whole-Genome Sequencing To Predict Zoonotic Risk", Appl Environ Microbiol. Feb. 1, 20185; 84(4): e02262-17.
Vrba et al., "Quantitative real-time PCR assays for detection and quantification of all seven *Eimeria* species that infect the chicken", 2010, Vet. Parasitol 174: 183-190.
Williams et al., "A compartmentalized model for the estimation of the cost of coccidiosis to the world's chicken production industry", 1999, Int. J. Parasitol. 29: 1209-1229.
Williams et al., "Intercurrent coccidiosis and necrotic enteritis of chickens: rational, integrated disease management by maintenance of gut integrity", 2005, Avian Pathol. 34: 159-180.

* cited by examiner

BACKGROUND DEFOCUSING AND CLEARING IN FERROFLUID-BASED CAPTURE ASSAYS

CROSS-REFERENCE TO RELATED APPLICATIONS

This application is a continuation of U.S. patent Ser. No. 15/739,466 filed Dec. 22, 2017, entitled "Background Defocusing and Clearing in Ferrofluid-Based Capture Assays", which is a national stage application of and claims priority to International Patent Application No. PCT/US2016/039394, filed Jun. 24, 2016, and entitled "Background Defocusing and Clearing in Ferrofluid-Based Capture Assays," which in turn claims priority to U.S. Provisional Patent Application No. 62/185,534, filed Jun. 26, 2015, and entitled "Background Defocusing and Clearing in Ferrofluid-Based Capture Assays." The present application incorporates herein by reference the disclosures of each of the above-referenced applications in their entireties.

FIELD OF THE DISCLOSURE

The present disclosure relates to methods and systems for extracting particles from ferrofluids and defocusing background particles from capture regions of assays.

BACKGROUND

WO2011/071912, WO2012/057878, and WO2014/144782 present systems and methods for separating microparticles or cells contained in a ferrofluid medium using magnetic forces. Magnetic field excitations can sort, separate, focus, and even capture cells and other microparticles.

Mechanical exclusion, via well-known filtration is, by its very nature, prone to clogging, and also subsequent increases in pressure drop across the filter as the filter becomes more and more clogged. Such filtration means rely on physically stopping a large enough target particle across a smaller opening on a surface. Additionally, diffusion on traditional assays is slowed by speed limitations. For example, in traditional immunoassays, multiple time-consuming and labor-intensive wash cycles are required between steps.

SUMMARY OF SOME OF THE EMBODIMENTS

Some embodiments of this disclosure present systems, methods and devices which remove background particles from a capture region of an assay.

Some embodiments of the subject disclosure present one or more additional features and/or functionality to methods, systems and devices presented in previous disclosures including, for example, PCT Publication Nos. WO2011/071912, WO2012/057878, and WO2014/144782, all of which are herein incorporated by reference in their entireties.

In some embodiments, methods for extracting target particles contained in a ferrofluid are provided. Such methods may comprise receiving a flow within a microchannel. The flow may comprise a plurality of target particles and background particles in a ferrofluid. A first magnetic field may be generated, and the first magnetic field may be a focusing excitation. At least two sets of electrodes arranged proximate to the microchannel may be used to generate the first magnetic field. The first set of electrodes may generate a first alternating current and the second set of electrodes may generate a second alternating current. The first and second alternating currents may be out of phase by a phase differential. In some embodiments, the focusing excitation may focus the flow of a plurality of target particles to a capture region, and the capture region may be functionalized with capture molecules that can each be configured to bind with a target particle. The capture region may capture a plurality of target particles by binding the target particles with the capture molecules.

In some embodiments, a plurality of unbound particles may also collect in the capture region. A second magnetic field that corresponds to a defocusing excitation may be generated by reversing the phase differential between the first alternating current and the second alternating current. The defocusing excitation may be configured to remove unbound particles from the capture region without removing target particles bound to the capture molecules. A detector may be used to detect the bound target molecules.

In some embodiments, a system for extracting target particles from a ferrofluid is provided and includes a microchannel configured to receive a flow comprising a plurality of target particles and background particles in a ferrofluid, and at least two sets of electrodes arranged proximate the microchannel, the at least two sets of electrodes configured to generate a first magnetic field and a second magnetic field. The first magnetic field corresponds to a focusing excitation and the second magnetic field corresponds to a defocusing excitation. The focusing excitation generated by a first of the at least two sets of electrodes generating a first alternating current and a second of the at least two sets of electrodes generating a second alternating current, where the first alternating current is out of phase with the second alternating current by a phase differential. The defocusing excitation is generated by reversing the phase differential of the focusing excitation. The system also includes a capture region functionalized with a plurality of capture molecules, each capture molecule configured to bind with one target particle type. The focusing excitation focuses the flow of target particles toward the capture region, wherein a plurality of the target particles bind with the capture molecules and a plurality of unbound background particles collect in the capture region, and the defocusing excitation removes the unbound background particles from the capture region without removing the target particles bound to the capture molecules. The system may also include a detector to detect the bound target particles.

In some embodiments, a system for extracting target particles from a ferrofluid is provided and includes a microchannel configured to receive a plurality of target particles and background particles in a ferrofluid, a plurality of electrodes arranged proximate the microchannel, the electrodes configured to generate a first magnetic field and a second magnetic field, wherein the first magnetic field corresponds to a focusing excitation and the second magnetic field corresponds to a defocusing excitation, and a capture region functionalized with a plurality of capture molecules, each capture molecule configured to bind with one target particle type.

In some embodiments, a method for extracting target particles from a ferrofluid is provided and includes receiving a plurality of target particles and background particles in a ferrofluid in a microchannel, generating a first magnetic field corresponding to a focusing excitation from a first set of electrodes, capturing a plurality of target particles in the capture region via the binding of the target particles with the capture molecules, where a plurality of unbound particles collect in the capture region, and generating a second magnetic field corresponding to a defocusing excitation to remove unbound particles from the capture region without removing target particles bound to the capture molecules.

BRIEF DESCRIPTION OF SOME OF THE EMBODIMENTS

DETAILED DESCRIPTION OF SOME OF THE EMBODIMENTS

Figure 1:
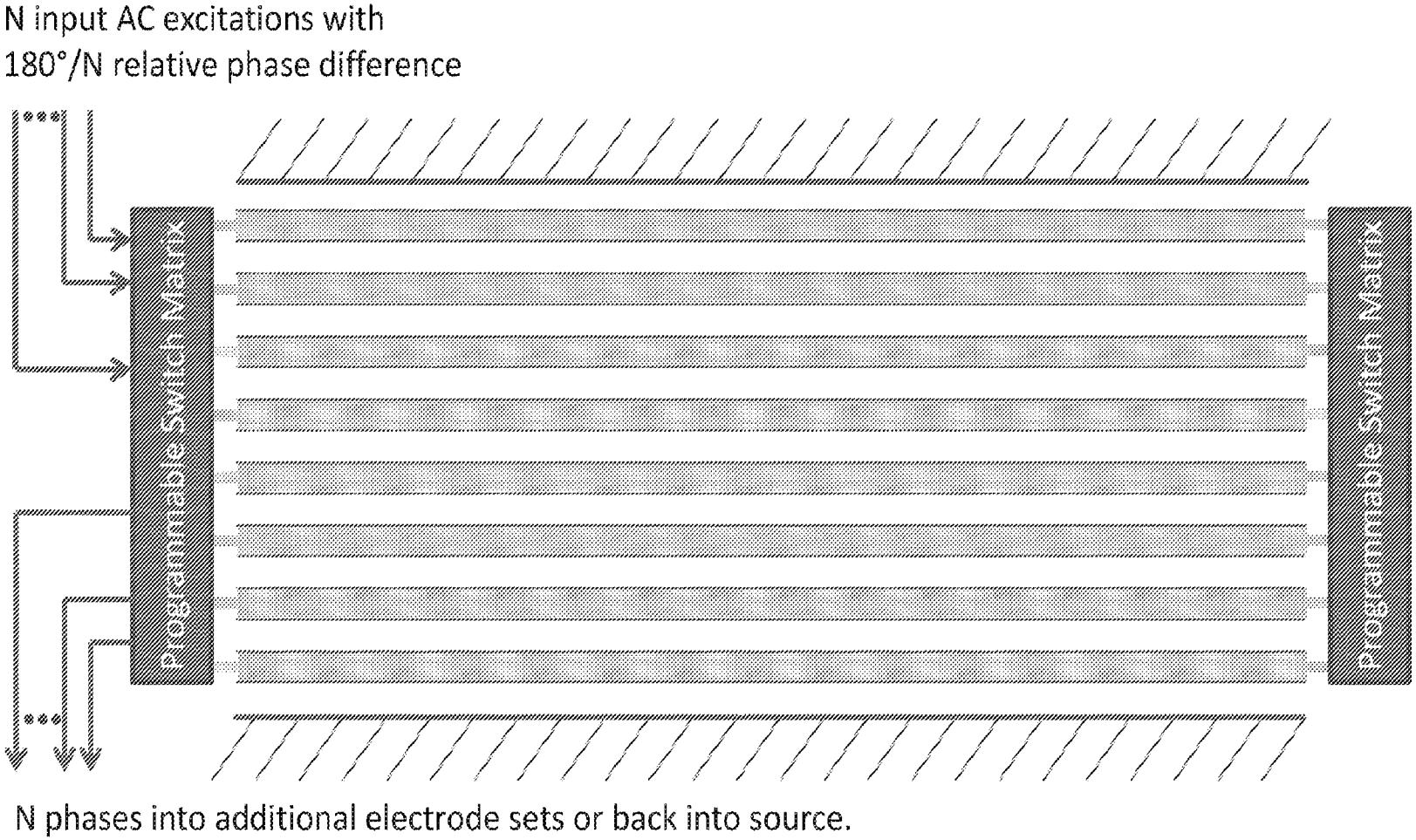
FIG. 1 is an illustration depicting structures of a fluidic channel and associated structures, including programmable switch matrices and electrodes, according to some embodiments.

In some embodiments, a fluidic channel may have multiple electrodes proximate thereto. A flow containing target and background particles may be introduced into the channel, and a capture region (also referred to herein as a "capture window") may be situated within the channel to capture the target particles contained in the flow. The multiple electrodes may be used to generate a magnetic field that focuses and defocuses the particles contained within the flow. Focused particles may form a condensed stream of particles, whereas defocused particles may move towards the side walls of the channel.

The electrodes may be spaced from each other by any amount of separation distance provided that contemporary technological and manufacturing capabilities allow the spacing of the electrodes by such separation distances. For example, the electrode separation distance maybe as small as manufacturing tolerances would allow (e.g., about 50 microns). Similarly, the separation distance may be as large as possible without negatively affecting the performance of the fluidic channel, i.e., while avoiding inefficiencies that accompany large electrode separations, such inefficiencies including fewer electrodes to generate the magnetic field for each unit area, diminished focusing and defocusing abilities (e.g., particles may collect along the surface of the fluidic channel (between the electrodes) instead of moving laterally across the electrodes), etc. As an example, the large electrode separation may be about 500 microns apart. As such, in some embodiments, the electrode separation distance may range from about 50 microns to about 500 microns, from about 100 microns to about 400 microns, from about 200 microns to about 300 microns, about 250 microns, and/or the like. In some embodiments, the separation distance may be less than about 50 microns. In some embodiments, the separation distance may be larger than about 500 microns. The separation distance may be a conveniently defined parameter to characterize the separation between electrodes. For example, for electrodes that are shaped as rectangular strips and aligned in a parallel configuration, the separation distance may be the distance between the closest longitudinal edges of neighboring electrodes. In some embodiments, the separation distance may not be constant, i.e., it may be changing, along the length of the fluidic device.

In some embodiments, the electrodes may be configured to form sets of electrodes, and the spacing between the sets of the electrodes may be determined by spacing of parallel flow channels in a disposable cartridge. The sets of electrodes may be programmable to generate one or more magnetic fields. In some embodiments, any number of sets of electrodes may be used where a set of electrodes can generate alternating current that may be out of phase with respect to alternating current generated by another set of electrodes. In some embodiments, these sets of electrodes may be configured to receive alternating current. For example, in some embodiments, two sets of electrodes may be used. A first set of electrodes can generate a first alternating current, and a second set of electrodes can generate a second alternating current that is out of phase with the first alternating current. In some embodiments, the first set of electrodes can receive a first alternating current and the second set of electrodes can receive a second alternating current. The sets of electrodes may be configured on printed circuit boards. The sets of electrodes may be parallel electrodes. The electrodes may be configured to generate the excitations.

In some embodiments, the set of electrodes may be configured in a variety of configurations. For example, the set of electrodes may be at least substantially parallel to each other or have major longitudinal axes that align with each other along the length of the fluidic channel. Further, the electrodes may have any shape, ranging from a rectangular strip to a completely irregular shape (albeit with a major axis running along and/or substantially parallel to the length of the fluidic channel). The width of the electrodes may also vary along the length of the fluidic channel. In some embodiments, the width may be substantially constant (for example, electrodes shaped as regular rectangular strips). The width of the electrodes may range from about 50 microns to about 1000 microns, from about 100 microns to about 800 microns, from about 200 microns to about 600 microns, from about 300 microns to about 500 microns, from about 350 microns to about 450 microns, about several mms (e.g., 2 mm, 3 mm, 4 mm, 5 mm, etc.), and/or the like.

In some embodiments, the configuration of the electrodes (e.g., shape, electrode separation distance, size etc.) may be selected so as to facilitate the focusing and defocusing of particles in fluids in the fluidic channel. The fluids such as ferrofluids may contain or be configured to receive samples (e.g., cells, particles (e.g., microbeads), etc.) for focusing, defocusing, capturing, etc., along the fluidic channel. The configurations of the electrodes such as the separation distance between electrodes, the size (e.g., length, width, etc.) and shape of the electrodes, the number of electrodes in an electrode set and/or the fluidic channel, etc., may depend on the properties of the fluid and the sample cells or particles to be captured, such properties including shape, size, elasticity, density, etc., of the cells or particles, viscosity of the ferrofluid containing the sample, etc. Such configurations may be programmable.

FIG. 1 shows an exemplary configuration, wherein AC excitations are inputted with a relative phase difference. In some embodiments, the relative phase difference may be about +/−180°/n, where n is the number of sets of electrodes being used. Thus, for example, if two sets of electrodes are used, the relative phase difference would be about +/−ninety degrees (+/−90°), and if three sets of electrodes are used, the relative phase difference would be about +/−sixty degrees (+/−60°). In some embodiments the AC excitations may be periodic or substantially periodic excitations. For example, the excitations may be sinusoidal waves, square waves, rectangular waves, triangular waves, sawtooth waves, pulse waves, arbitrary periodic waves, and/or the like.

A programmable switch matrix may be used to control which electrodes are connected to form each set of electrodes at either side of the channel. As a result, the electrode configuration may be reconfigurable using the programmable switch matrices on either end of the electrodes. For example, a user may be able to enter a number of sets of electrodes and/or a configuration of the sets of electrodes into a programmable switch matrix. In some embodiments, the user may enter the number of sets of electrodes (s)he would like to use for a particular run, and the programmable switch matrix may determine an optimal configuration of the electrodes and may connect the electrodes according to the optimal configuration. In another embodiment, the user may enter a particular configuration and/or the number of sets of electrodes, and the programmable switch matrix will configure the connectors to connect the electrodes as instructed by the user. The configuration of the connectors that connect the electrodes may be controlled electronically or through software. The connectors may be reconfigured for each application, and in some embodiments, the configuration may be changed during the course of a focusing and/or defocusing.

After the AC excitations pass through the set(s) of electrodes, the output excitations may be inputted into additional electrode sets, may go back to the source, and/or may go to another output mechanism. For example, in some embodiments, multiple sets of electrodes could be used for multiple fluidic channels that are arranged in parallel or in series.

In an example with two sets of electrodes, the first alternating current and second alternating current may be out of phase by about +/−ninety degrees (+/−90°). A focusing excitation may be created by about a −90° phase difference (e.g., where the phase of the second alternating current lags the phase of the first alternating current by about 90°), while a defocusing excitation may be created by a about +90° phase difference (where the phase of the second alternating current leads the phase of the first alternating current by about 90°). In other embodiments, a different number of sets of electrodes (n) may be used, and the alternating currents may be out of phase by about +/−180/n degrees. For example, if there are three sets of electrodes, and the first alternating current, second alternating current, and third alternating current may be out of phase by about +/−sixty (+/−60°) degrees, and so on. In some embodiments, non-optimal phase differences may be used. A non-optimal phase difference may occur when the currents are out of phase by an amount other than about +/−180°/n.

When sets of electrodes are excited simultaneously, a traveling magnetic field may be created. The traveling magnetic field may spin particles flowing through the channel in a particular direction, which may focus or defocus the particles. In some embodiments, an ideal phase differential (about +/−180/n) may produce a high-intensity focusing or defocusing of the particles, while a non-optimal phase difference may modulate the intensity of the focusing or defocusing of the particles. In some embodiments, particle rotation may be maximized at ideal phase differences. In some embodiments, a non-optimal phase difference may be used to control the relative speed of particle rotation with respect to particle translation due to the magnetic forces. Non-optimal phase differences may also allow for size-based, shape-based, and/or elasticity-based separation of particles. In some embodiments, this separation may be achieved by changing excitation frequency, however this may also occur without changing the excitation frequency. In some embodiments, the focusing and defocusing of cells or particles can also be controlled by controlling the amplitude and/or the on/off duration of the AC waveform. For example, the magnetic field coupled to the flow channels can be varied by controlling the amplitude of the AC input waveform (e.g., the periodic or substantially periodic AC input) and/or modulating its on/off duration (i.e., a generalized pulse width modulation scheme), thereby affecting the focusing/defocusing of the cells/particles.

Figure 2:
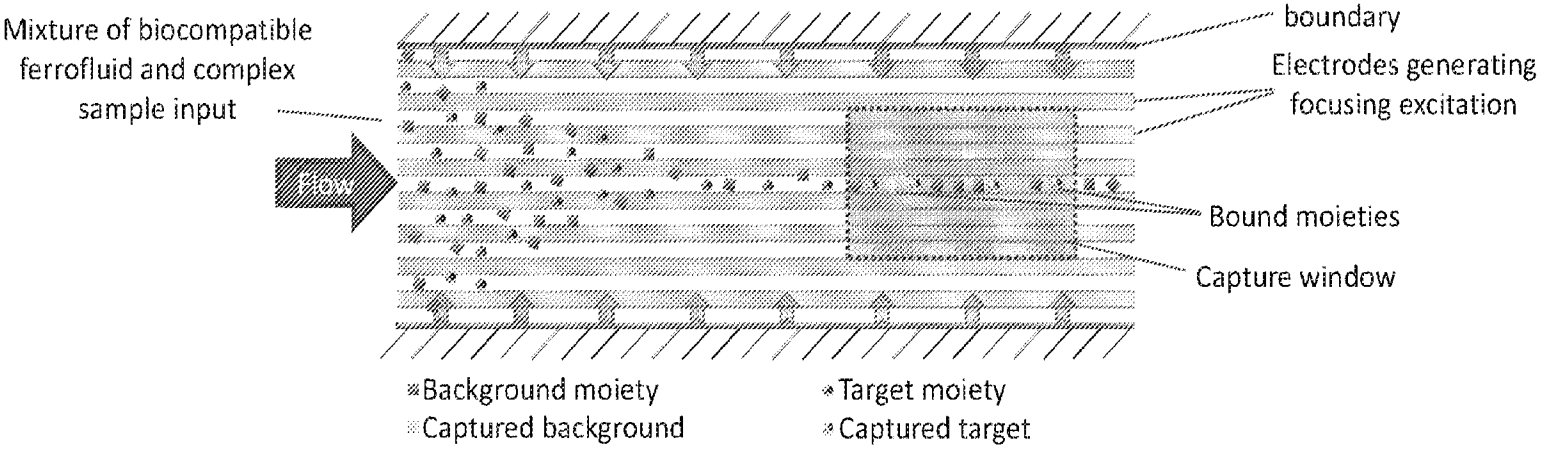
FIG. 2 is an illustration depicting structures of a fluidic channel and associated structures containing a ferrofluid and a mixture of microparticles during a focusing excitation, according to some embodiments.

As shown in FIG. 2, a flow may enter the channel, and the electrodes may generate a focusing excitation. The flow may comprise or be configured to receive both target particles/cells and background particles/cells suspended in biocompatible ferrofluid; one possible example of such flow includes rare circulating tumor cells in a large background of various different blood cells. In some embodiments, the flow may comprise a mixture of biocompatible ferrofluid and complex sample; one possible example of such flow consists of target bacterial cells in a complex food matrix. In some embodiments, the target particles may be a collection of microbeads functionalized with different ligands and suspended in a biocompatible ferrofluid; such embodiments would be able to run multiplex bead-based assays within the same flow by clearing from the capture region any beads that have not specifically bound their target antigen or cell.

Figure 3:
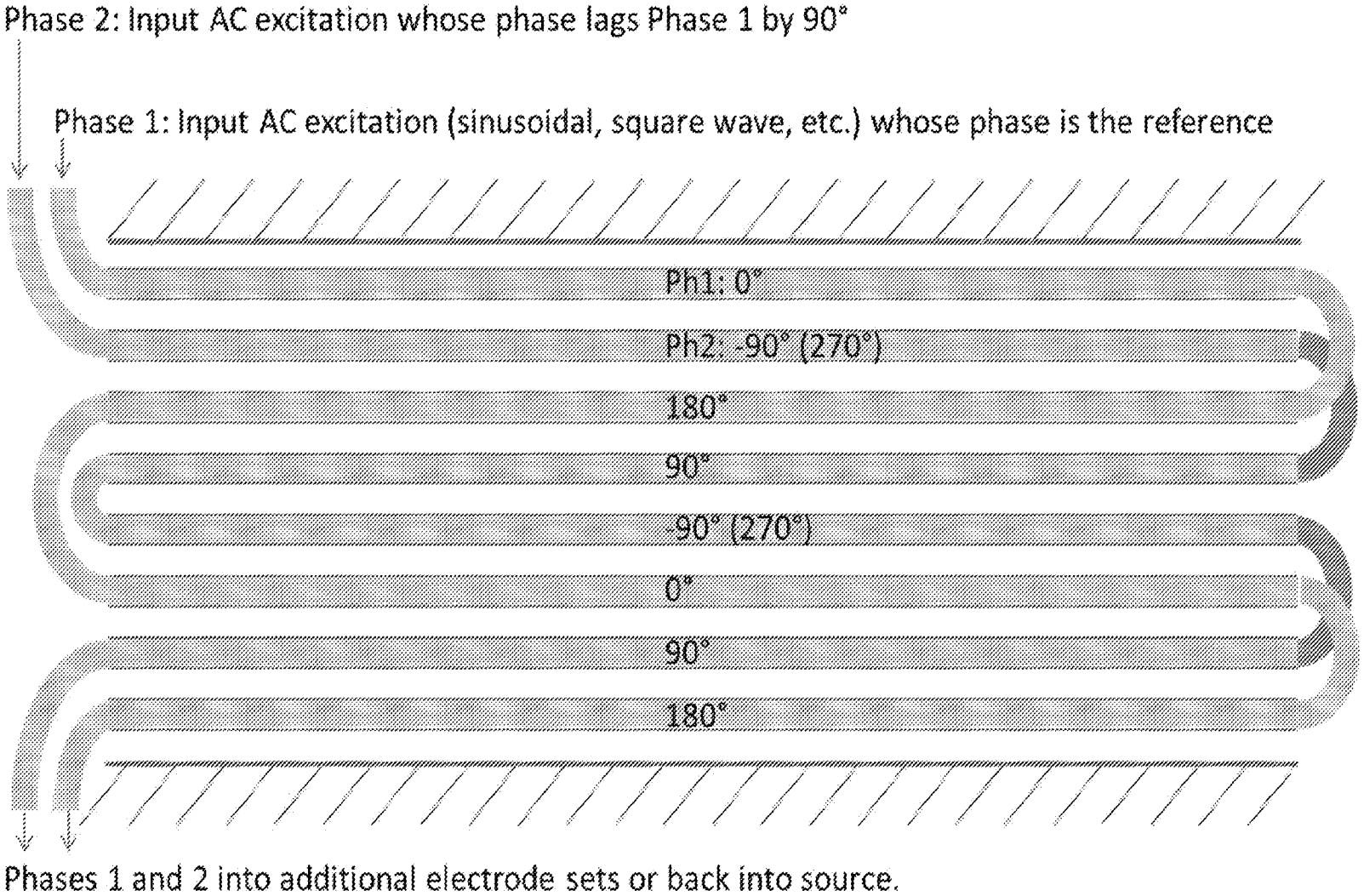
FIG. 3 is an illustration depicting structures of a fluidic channel and associated structures, including sets of electrodes and exemplary switch configurations, according to some embodiments.

As explained above, in some embodiments, the focusing excitation may be created by multiple sets of electrodes, such as two sets of electrodes having currents that are out of phase by about −90°. FIG. 3 shows a sample embodiment of the configuration of an exemplary focusing configuration with two sets of electrodes. In some embodiments, electrodes may extend the length of the channel. The electrodes may be connected in a specific configuration, or the configuration may be programmable. The connection of the electrodes may connect the individual electrodes to form the sets of electrodes. Thus, a current applied to a first electrode may travel through the first electrode and through the connector and back along another electrode. In some embodiments, such as the embodiment shown in FIG. 3, multiple electrodes and connectors are used to form each set of electrodes; here, there are four electrodes and three connectors used to form each set of electrodes.

In some embodiments, the electrodes and/or the connectors may be configured on separate connection layers such that the electrodes and/or connectors in one set do not touch electrodes and/or connectors of another set. In some embodiments, the connectors can be outside the plane of the electrodes. In embodiments where the electrodes are on printed circuit boards, the connectors may be wire bonds, and/or passive or active elements bonded externally to contact pads on the printed circuit board.

In some embodiments, a multi-level printed circuit board may be used, and the connectors may be internal traces on lower electrode layers on a multi-level printed circuit board. In such an embodiment, the internal electrode layers may also support additional sets of electrodes. This may allow for an augmented magnetic field to be generated when compared to the magnetic field generated by one layer of electrodes.

A first AC input excitation is inputted into and/or generated by a first set of electrodes. This first AC input may be a periodic or substantially periodic excitation such as but not limited to sinusoidal wave, a square wave, or a similar excitation. The phase of the first AC input in the first set of electrodes serves as the reference phase. A second AC input excitation is sent into a second set of electrodes. The phase of the second AC input excitation may be offset from the phase of the first AC excitation by about −90°. Thus, the phase of the second AC input excitation may lag the phase of the first AC excitation by about 90°, is a focusing excitation which results in the focusing of the particles.

As shown in FIG. 3, Phase 1, which serves as the reference phase, may be referred to as a phase offset of about 0°. Because Phase 2 lags Phase 1 by about 90° in this embodiment, Phase 2 is shown as about −90°, which is also equivalent to about 270°. When the excitations loop back along the length of the channel through another electrode, the phase of Phase 1 becomes about 180°, while the phase of Phase 2 becomes about 90°. In some embodiments, the electrodes may loop down the side of the channel one or more additional times. For example, in the embodiment shown, the excitations may pass through four electrodes and three connectors.

Figure 4:
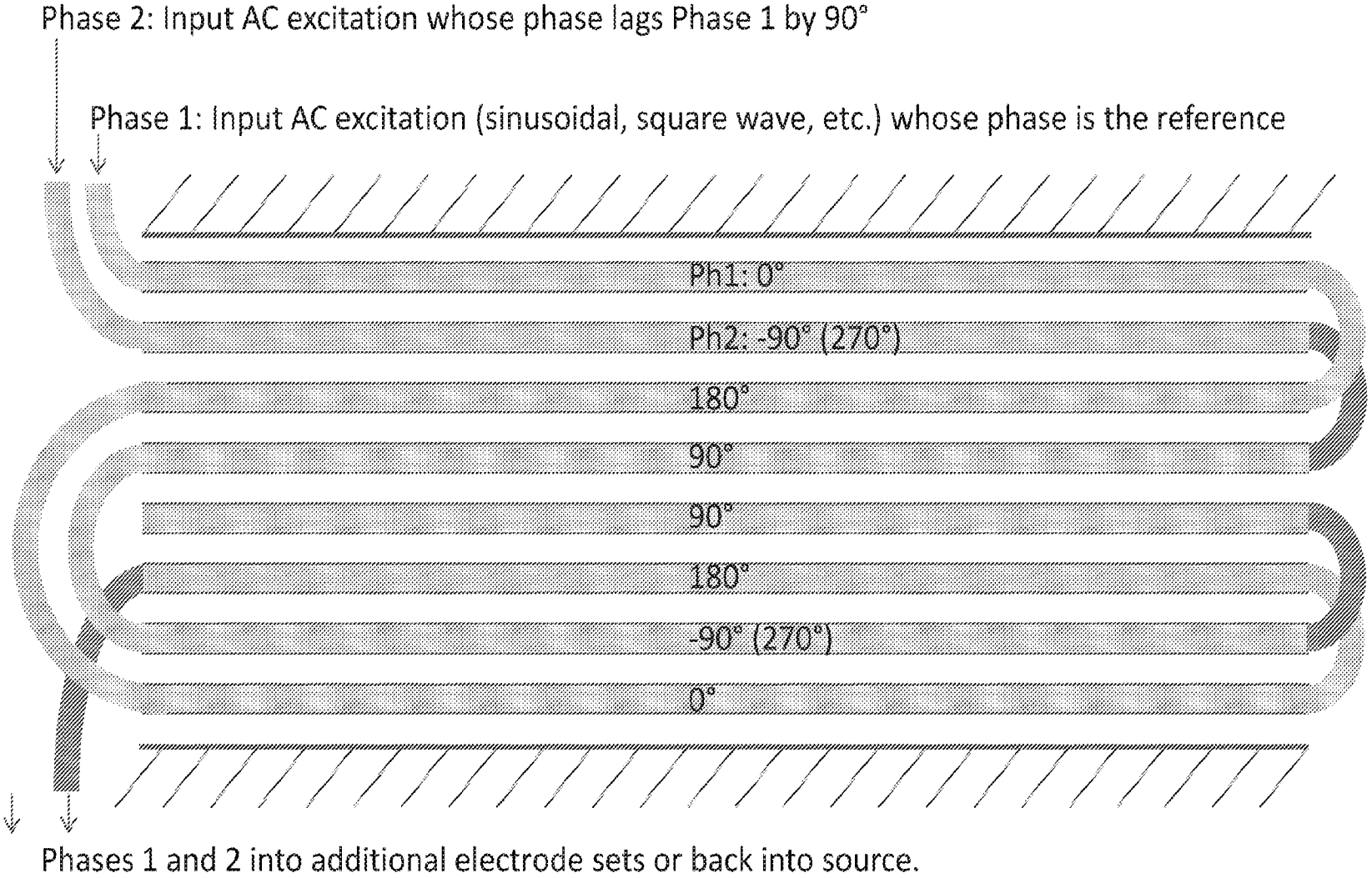
FIG. 4 is an illustration depicting structures of a fluidic channel and associated structures, including sets of electrodes and exemplary switch configurations, according to some embodiments.

FIG. 4 shows an alternative embodiment with two sets of electrodes in a focusing configuration.

Figure 5:
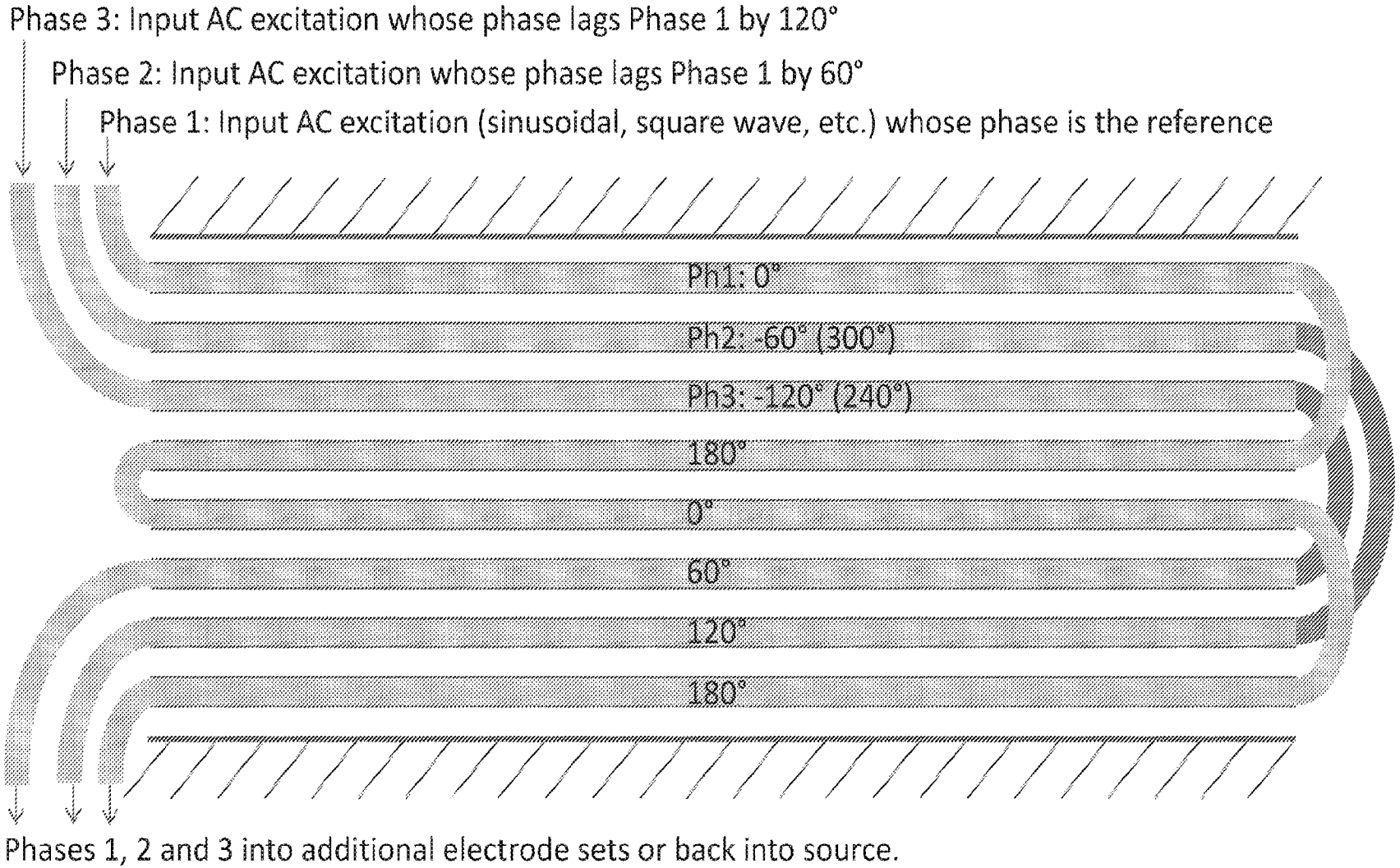
FIG. 5 is an illustration depicting structures of a fluidic channel and associated structures, including sets of electrodes and exemplary switch configurations, according to some embodiments.

FIG. 5 shows an embodiment with three sets of electrodes in a focusing configuration. Here, the phase difference between the phase of the AC excitation in the first set of electrodes (about 0°) lags the phase of Phase 2 in the second set of electrodes by about 60° and Phase 3 in the third set of electrodes by about 120°.

Figure 6:
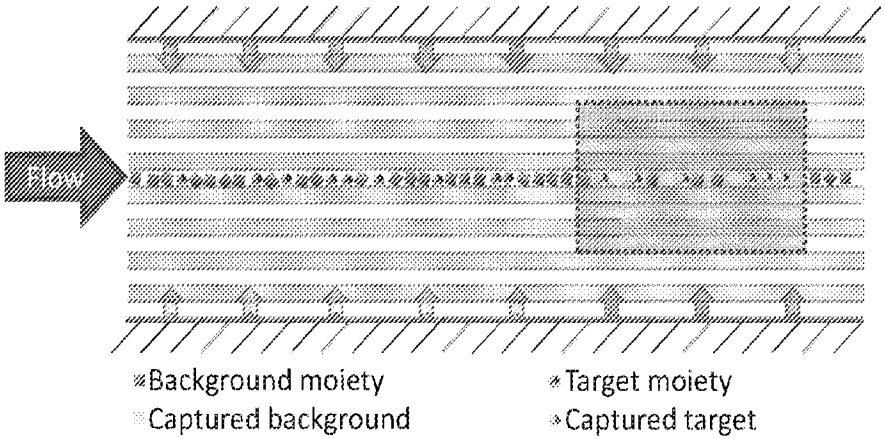
FIG. 6 is an illustration depicting structures of a fluidic channel and associated structures containing a ferrofluid and a mixture of microparticles in a steady state during a focusing excitation, according to some embodiments.

When the focusing excitation is applied, the particles may be focused towards the center of the microchannel, as shown in FIG. 2. In some embodiments, the focusing excitation may create a traveling magnetic field that may cause the particles to rotate in a particular direction. This rotation of the particles may result in particles that are focused into a concentrated stream in the flow within the channel. FIG. 6 shows the channel in a steady state wherein the focusing excitation is applied and the particles are concentrated into a stream. In some embodiments, such as those depicted in FIGS. 2 and 6, the particles may be tightly focused (e.g., to the center of the channel). In some embodiments, the focusing may be partial where some particles may be focused into a streamlined flow while others may be traveling through the channel in a diffuse manner. In any case, the capturing of some or all of the focused as well as the partially focused particles may be accomplished over the capture window. In some embodiments, the electrodes and their associated properties (size, shape, electrode separation, etc.), the AC excitations (e.g., amplitude, periodicity, on/off duration, etc.), etc., may be selected so as to control the amount of focusing (e.g., streamlined or merely diffuse but within the capture window, etc.) of the particles in the flow to facilitate the capturing of the particles over the capture window.

The focused stream of FIG. 2 and/or FIG. 6 may travel towards a capture window. The capture window may be part of a fluidic device, which, in some embodiments, may be a disposable cartridge. The capture region may have capture molecules configured to bind with the target particles. In some embodiments, the capture molecules may specifically bind with target particles. While some background particles may pass through the capture window, the capture window may immobilize at least some background particles. These immobilized particles may not specifically bind with the capture molecules in the capture region.

In some embodiments, a defocusing excitation may be applied to the channel, such as by changing the phase differential between the alternating currents. In some embodiments, the phase differential for the defocusing excitation may be determined by inverting the phase differential used for the focusing excitation. For example, two sets of electrodes may generate a defocusing excitation by reversing the phase differential used in the focusing excitation, such as two sets of electrodes having currents that are out of phase by about +90°.

Figure 7:
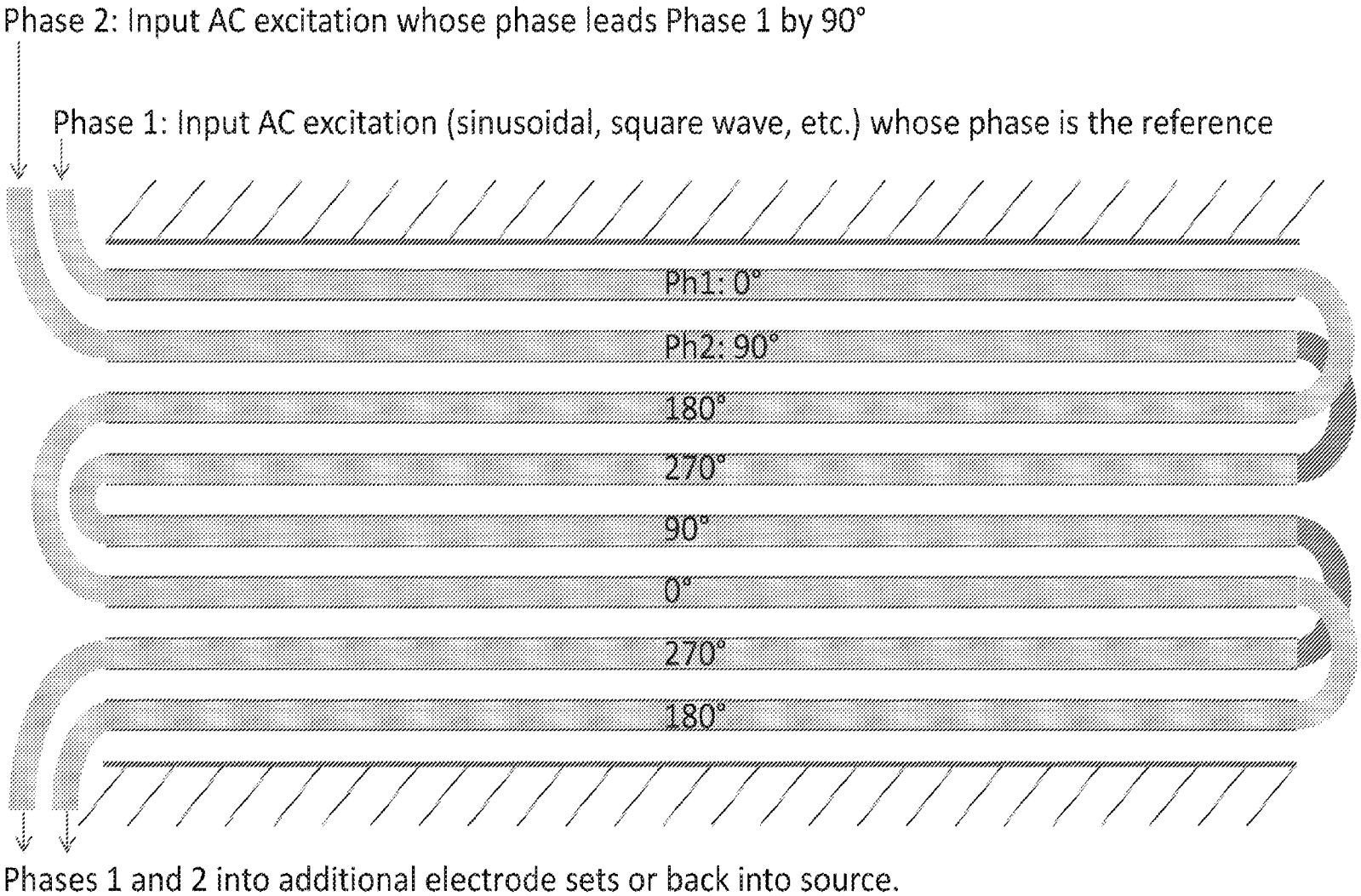
FIG. 7 is an illustration depicting structures of a fluidic channel and associated structures, including sets of electrodes and exemplary switch configurations, according to some embodiments.

FIG. 7 shows an exemplary embodiment with two sets of electrodes. This defocusing excitation is configured similarly as compared to the focusing excitation shown in FIG. 3, but here Phase 2 leads Phase 1 by about 90°. Phase 1, which has input AC excitation comprising a periodic or substantially periodic excitation such as sinusoidal excitation, square wave excitation, and/or other similar excitation, serves as the reference phase (0°), and Phase 2, the phase of the second AC excitation, is offset by about +90°. This phase difference may be a defocusing excitation that results in the defocusing of the particles.

Figure 8:
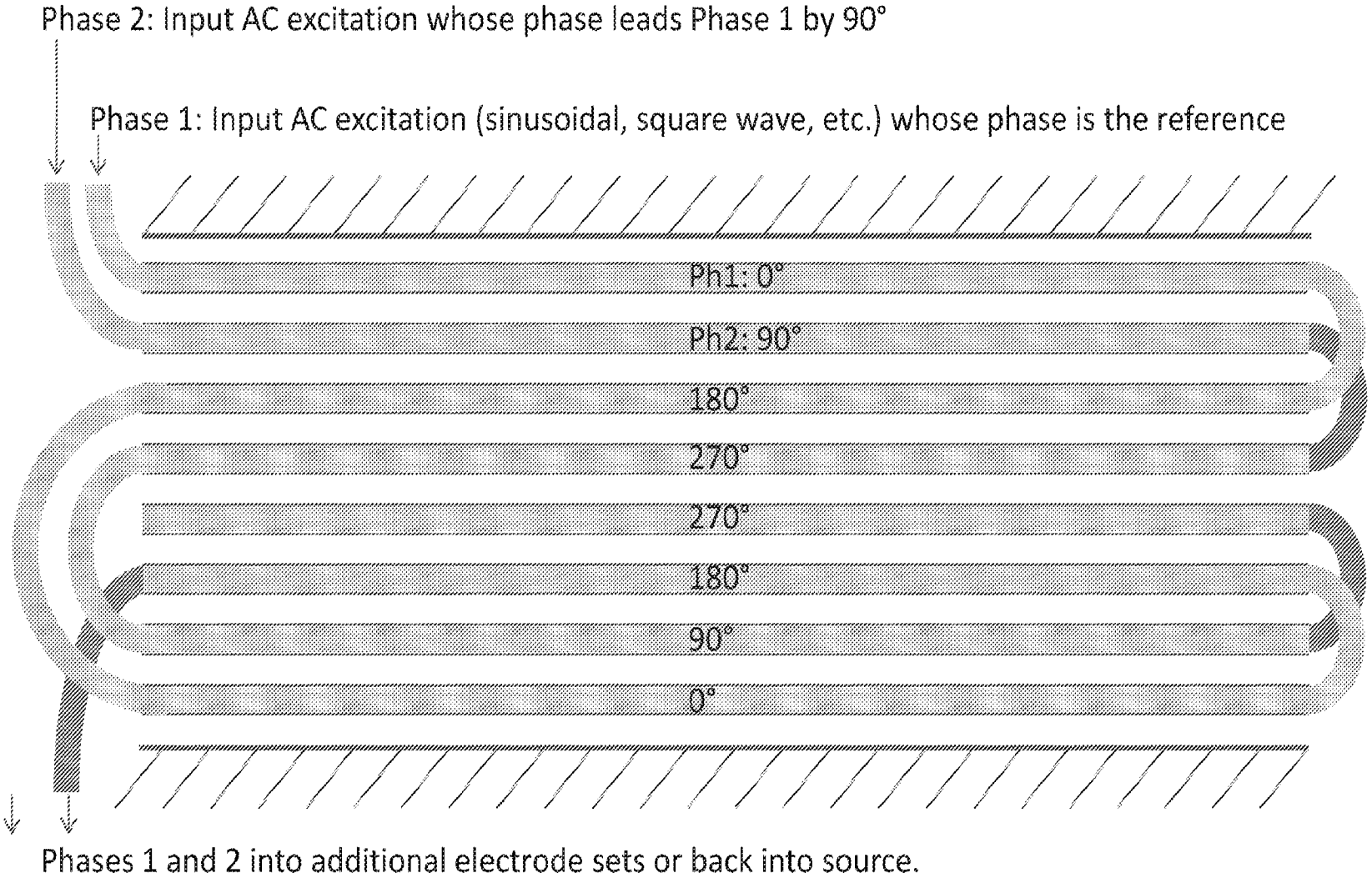
FIG. 8 is an illustration depicting structures of a fluidic channel and associated structures, including sets of electrodes and exemplary switch configurations, according to some embodiments.

As shown in FIG. 7, Phase 1, the reference phase, has on offset of about 0°. Phase 2, which leads Phase 1 by about 90°, is therefore about +90°. When the excitations loop back along the length of the channel through a second electrode, the phase of Phase 1 becomes about 180°, while the phase of Phase 2 is about 270°. The excitations may loop back down the length of the channel one or more additional times. For example, in the embodiment shown in FIG. 7, the excitations may travel through four electrodes and three connectors. FIG. 8 shows an alternative embodiment of the defocusing configuration of the electrodes in another embodiment with two sets of electrodes.

Figure 9:
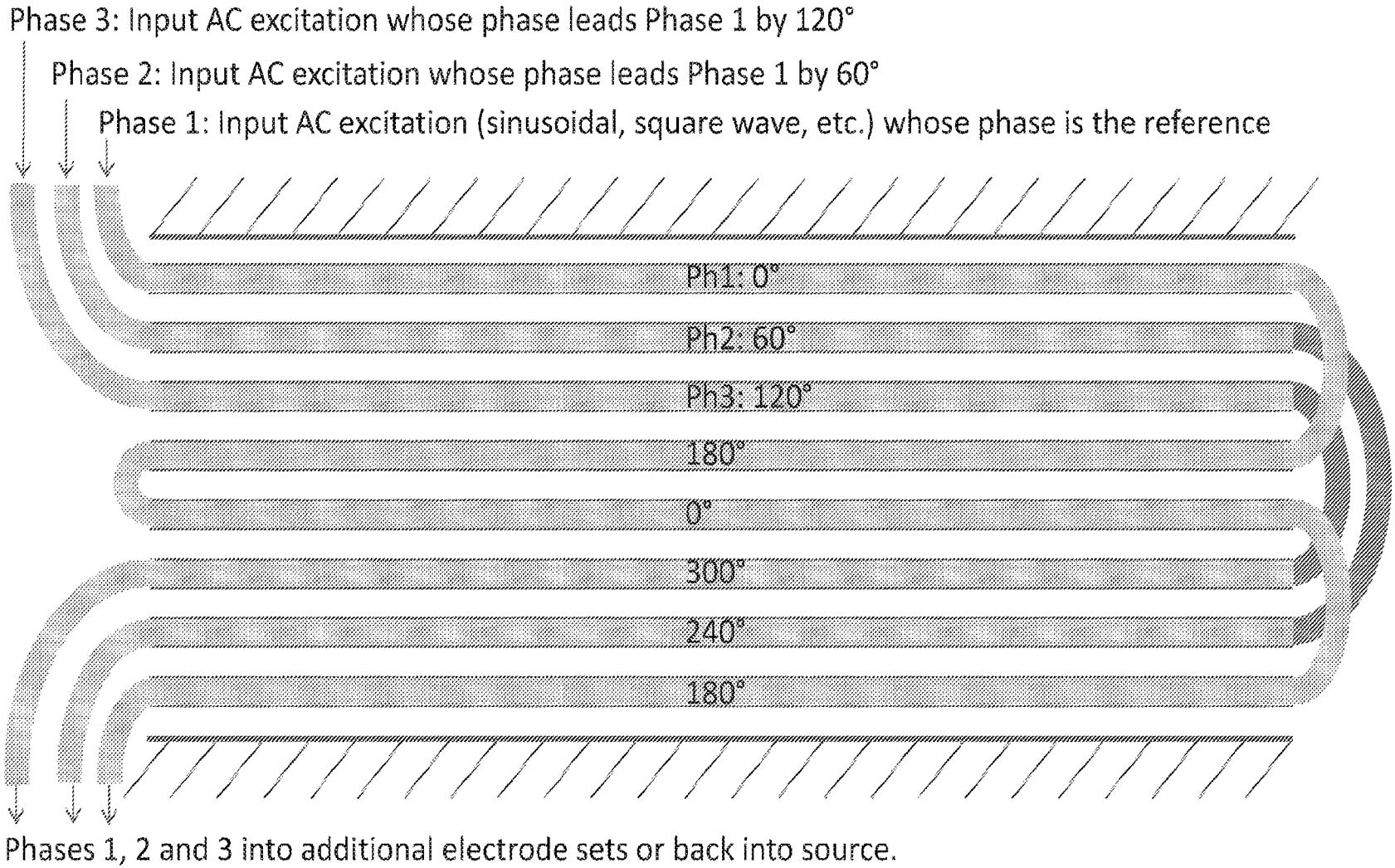
FIG. 9 is an illustration depicting structures of a fluidic channel and associated structures, including sets of electrodes and exemplary switch configurations, according to some embodiments.

FIG. 9 shows an embodiment with three sets of electrodes in a defocusing configuration. As explained above, the defocusing configuration may be generated using multiple ("n") sets of electrodes with alternating currents out of phase by about +180°/n, such that the phase of the second and third sets of electrodes lead the first set of electrodes. Thus, an ideal configuration for a three-electrode defocusing embodiment may be a about +60° phase differential between the first and second sets of electrodes and a about +60° phase differential between the second and third sets of electrodes.

Here, the phase difference between Phase 1, the phase of the AC excitation in the first set of electrodes (about 0°) leads the phase of Phase 2 in the second set of electrodes by about 60° and Phase 3 in the third set of electrodes by about 120°. As shown, the first set of electrodes may be configured to traverse the length of the channel four times, and the second and third set of electrodes may traverse the length of the channel twice. This creates a about 60° phase differential between Phase 1 and Phase 2, Phase 2 and Phase 3, and Phase 3 and Phase 1 in the second electrode as the current traverses the opposite direction along the length of the channel. A similar about 60° differential is created between the third traversal of Phase 2, the second traversal of Phase 2 and Phase 3, and the fourth traversal of Phase 1.

Figure 10:
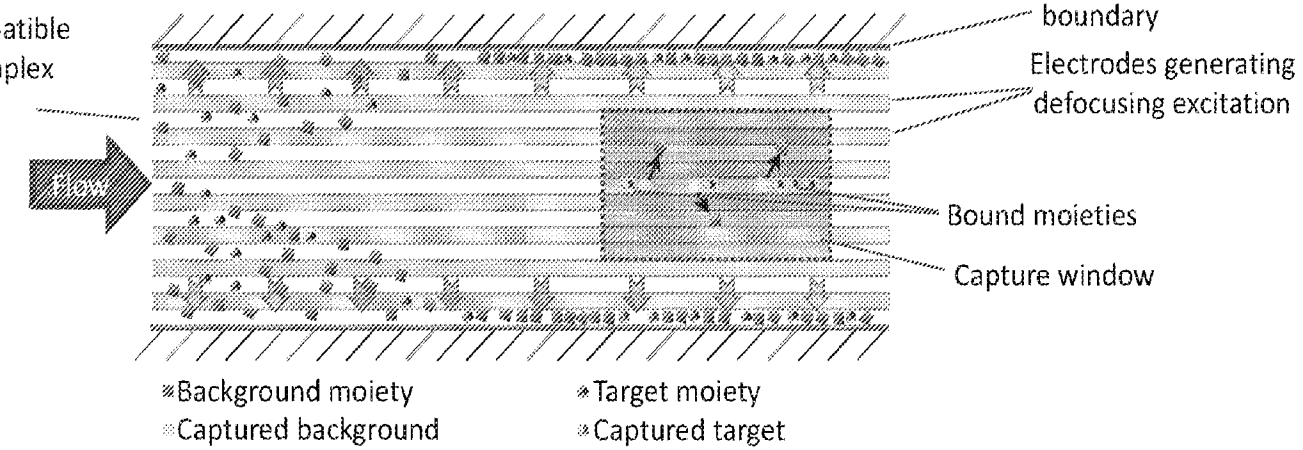
FIG. 10 is an illustration depicting structures of a fluidic channel and associated structures containing a ferrofluid and a mixture of microparticles during a defocusing excitation, according to some embodiments.

As shown in FIG. 10, the defocusing excitation may change the direction of the spin of the particles, resulting in the particles moving towards the side walls of the channel. In some embodiments, the defocusing excitation may stop movement of the particles toward the capture window. The defocusing excitation may remove the immobilized background particles from the capture window. Background particles may not be specifically bound to the capture molecules, and may therefore release from the capture window and move and/or spin towards the channel wall. Meanwhile, target particles that are specifically bound to the capture molecules may remain on the capture region.

Figure 11:
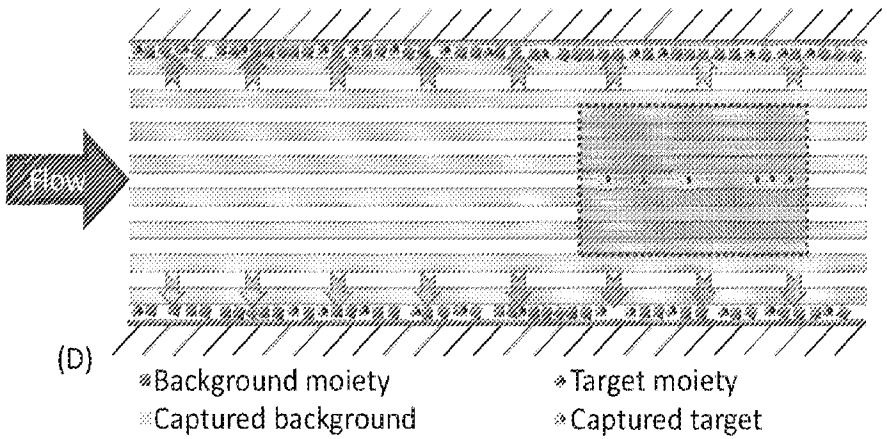
FIG. 11 is an illustration depicting structures of a fluidic channel and associated structures containing a ferrofluid and a mixture of microparticles in a steady state during a defocusing excitation, according to some embodiments.

In FIG. 11, this process has reached a steady state. At least some of the background particles that were within the capture window may have been displaced to the side wall of the channel, while at least some bound target particles may remain in the capture window. In some embodiments, all background particles may be removed from the capture window, and in some embodiments, a majority or at least a certain percentage of background particles may be removed from the capture window. In some embodiments, all target particles may remain in the capture window, and in some embodiments, a majority of target particles may remain in the capture window.

A detector may be used to determine whether the background particles, or at least some of the background particles, have been removed from the capture region. For example, the detector may determine that the amount of background particles on the capture region is over a threshold percentage or threshold number of background particles. A detector may also be used to determine that at least some target particles, or at least a certain amount (number or percentage) of target particles, have been captured by the capture region. In some embodiments, the detector may be an automated scanning microscope, a sensitive mass balance, an electrochemical sensor and/or the like. A sensitive mass balance may be a quartz crystal mass-balance; an electrochemical sensor may respond to the presence of live cells metabolizing over a surface of the capture region.

In some embodiments, once a capture region is determined to have at least a threshold (number of percentage) of target particles and/or determined to have below a certain threshold (number or percentage) of background particles, the capture region may be removed from the channel. In some embodiments, the removed capture region may be replaced with a new capture window.

In some embodiments, if a capture region is determined not to have at least a threshold of target particles, another focusing excitation may be applied, followed by another defocusing excitation. The detector may perform another test, and this process may continue until the detector senses that a sufficient amount (number or percentage) of target particles have been captured by the capture window.

In some embodiments, if a capture region is determined to have over a certain threshold of background particles, another defocusing excitation may be applied to remove the background particles from the capture window. The detector may perform an additional test, and this process may continue until the detector senses that a sufficient amount of background particles have been removed.

Any and all references to publications or other documents, including but not limited to, patents, patent applications, articles, webpages, books, etc., presented in the present application, are herein incorporated by reference in their entirety.

Example embodiments of the devices, systems and methods have been described herein. As noted elsewhere, these embodiments have been described for illustrative purposes only and are not limiting. Other embodiments are possible and are covered by the disclosure, which will be apparent from the teachings contained herein. Thus, the breadth and scope of the disclosure should not be limited by any of the above-described embodiments but should be defined only in accordance with claims supported by the present disclosure and their equivalents. Moreover, embodiments of the subject disclosure may include methods, systems and devices which may further include any and all elements from any other disclosed methods, systems, and devices, including any and all elements corresponding to target particle separation, focusing/concentration. In other words, elements from one or another disclosed embodiments may be interchangeable with elements from other disclosed embodiments. In addition, one or more features/elements of disclosed embodiments may be removed and still result in patentable subject matter (and thus, resulting in yet more embodiments of the subject disclosure). Correspondingly, some embodiments of the present disclosure may be patentably distinct from one and/or another reference by specifically lacking one or more elements/features. In other words, claims to certain embodiments may contain negative limitation to specifically exclude one or more elements/features resulting in embodiments which are patentably distinct from the prior art which include such features/elements.

What is claimed is:

1. A method for extracting target particles from a ferrofluid, the method comprising:

receiving a flow within a microchannel;

generating a first magnetic field corresponding to a focusing excitation, the first magnetic field generated by a plurality of electrodes arranged proximate the microchannel, wherein the focusing excitation is configured to focus the flow of a plurality of target particles to a surface of a capture region, capturing the plurality of target particles on the surface of the capture region;

generating a second magnetic field corresponding to a defocusing excitation, the defocusing excitation configured to remove unbound particles from the capture region without removing target particles bound to the capture molecules;

and detecting the bound target particles via a detector.

2. The method of claim 1, wherein the detector is at least one of an automated scanning microscope, a sensitive mass balance, and an electrochemical sensor.

3. The method of claim 1, wherein the focusing excitation caused by the first magnetic field rotates the particles in a first direction.

4. The method of claim 1, wherein the defocusing excitation caused by the second magnetic field rotates the particles in a second direction, wherein the rotation in the second direction causes the particles to defocus.

5. A method for extracting target particles from a ferrofluid, the method comprising:

receiving a plurality of target particles and background particles in a ferrofluid in a microchannel;

generating a first magnetic field corresponding to a focusing excitation;

capturing the plurality of target particles on a surface of a capture region via binding to capture molecules;

and generating a second magnetic field corresponding to a defocusing excitation to remove unbound particles from the capture region without removing target particles bound to the capture molecules.

6. A system for extracting target particles from a ferrofluid, the system comprising:

a microchannel configured to receive a flow comprising a plurality of target particles and background particles in a ferrofluid;

a plurality of electrodes configured to generate a first magnetic field and a second magnetic field, wherein the first magnetic field corresponds to a focusing excitation, and the second magnetic field corresponds to a defocusing excitation, a capture region arranged on a surface of the microchannel and functionalized with a plurality of capture molecules, each capture molecule configured to bind with one target particle, wherein the focusing excitation focuses the flow of target particles toward the capture region, whereby a plurality of the target particles bind with the capture molecules and a plurality of unbound background particles collect in the capture region, and the defocusing excitation removes the unbound background particles from the capture region which have collected there without removing the target particles bound to the capture molecules.

7. The system of claim 6, further comprising a detector to detect the bound target particles.

8. The system of claim 6, wherein the detector is one of: an automated scanning microscope, a sensitive mass balance, and an electrochemical sensor.

9. The system of claim 6, wherein the focusing excitation caused by the first magnetic field rotates the particles in a first direction.

10. The system of claim 9, wherein the rotation of the particles in the particular direction causes the particles to focus.

11. The system of claim 9, wherein the defocusing excitation caused by the second magnetic field rotates the particles in a second particular direction, wherein the rotation in the second particular direction causes the particles to defocus.

12. The system of claim 6, wherein a phase differential is determined using a total number of sets of electrodes used, such that the phase differential is +180 divided by the number of sets of electrodes and the reverse phase differential is −180 divided by the number of sets of electrodes.

13. A system for extracting target particles from a ferrofluid, the system comprising:

a microchannel configured to receive a plurality of target particles and background particles in a ferrofluid;

a plurality of electrodes arranged proximate the microchannel, wherein:

the electrodes configured to generate a first magnetic field and a second magnetic field, and the first magnetic field corresponds to a focusing excitation and the second magnetic field corresponds to a defocusing excitation;

and a capture region functionalized with a plurality of capture molecules, each capture molecule configured to bind with one target particle, wherein the defocusing excitation is configured to clear particles which collect in the capture region which do not bind with one or another of the plurality of capture molecules.

* * * * *